US009089010B2

(12) United States Patent
Weiss et al.

(10) Patent No.: US 9,089,010 B2
(45) Date of Patent: Jul. 21, 2015

(54) HEATER WIRE SAFETY CIRCUIT

(75) Inventors: John W. Weiss, Oakdale, NY (US); Kuang-Pu Liao, Pingzhen (TW)

(73) Assignee: Weiss Controls, Inc., Holtsville, NY (US)

( * ) Notice: Subject to any disclaimer, the term of this patent is extended or adjusted under 35 U.S.C. 154(b) by 772 days.

(21) Appl. No.: 13/306,030

(22) Filed: Nov. 29, 2011

(65) Prior Publication Data

US 2012/0199574 A1 Aug. 9, 2012

Related U.S. Application Data

(60) Provisional application No. 61/458,668, filed on Nov. 29, 2010, provisional application No. 61/516,802, filed on Apr. 8, 2011.

(51) Int. Cl.

| | |
|---|---|
| ***H05B 1/02*** | (2006.01) |
| ***H05B 3/56*** | (2006.01) |
| ***H05B 3/14*** | (2006.01) |

(52) U.S. Cl.

CPC ..... *H05B 3/56* (2013.01); *H05B 3/146* (2013.01); *H05B 2203/02* (2013.01)

(58) Field of Classification Search

CPC ..... H05B 3/56; H05B 3/12; H05B 3/146; H05B 2203/02; H05B 1/02; H05B 1/0202

USPC ..... 219/481, 494, 212, 528, 504, 505, 506, 219/508

See application file for complete search history.

(56) References Cited

U.S. PATENT DOCUMENTS

| | | | | |
|---|---|---|---|---|
| 4,278,874 | A | 7/1981 | Cole | 219/505 |
| 4,547,658 | A | 10/1985 | Crowley | 219/539 |
| 5,861,610 | A | 1/1999 | Weiss | 219/497 |
| 6,222,162 | B1 | 4/2001 | Keane | 219/481 |
| 6,310,332 | B1 | 10/2001 | Gerrard | 219/505 |
| 6,355,912 | B2 * | 3/2002 | Allard | 219/481 |
| 6,518,731 | B2 * | 2/2003 | Thomas et al. | 320/136 |
| 6,737,610 | B1 | 5/2004 | Horn et al. | 219/212 |
| 7,106,048 | B1 | 9/2006 | Feight et al. | 324/127 |
| 7,180,037 | B2 | 2/2007 | Weiss | 219/505 |

(Continued)

OTHER PUBLICATIONS

Notification of Transmittal of the International Search Report and the Written Opinion of the International Searching Authority, or the Declaration (in English) dated May 23, 2012, International Search Report (in English) dated May 23, 2012 and Written Opinion of the International Searching Authority (in English) dated May 23, 2012.

(Continued)

*Primary Examiner* — Mark Paschall
(74) *Attorney, Agent, or Firm* — Gerald T. Bodner

(57) ABSTRACT

A safety overheat protection circuit for flexible heater wire used in heating pads and electric blankets. The heater wire includes a low melt temperature fuse-able layer and a conductive core. A polymetric positive temperature coefficient (PPTC) device is used in series with the heater wire in a configuration so that a hot spot anywhere along the length of the wire will cause the fuse-able layer to melt and the heater wire to short to the conductive core, increasing the current and causing the PPTC device to change to a high impedance state significantly removing power to the heater wire. In addition, dual circuits having the same operating target temperature are presented as a safe method of temperature control.

16 Claims, 16 Drawing Sheets

(56) References Cited

U.S. PATENT DOCUMENTS

| | | | | |
|---|---|---|---|---|
| 8,124,918 | B2 * | 2/2012 | Hoffman | 219/502 |
| 8,183,504 | B2 * | 5/2012 | Montoya et al. | 219/511 |
| 8,687,339 | B2 * | 4/2014 | Wang | 361/106 |
| 2003/0052121 | A1 | 3/2003 | Sopory | 219/505 |
| 2003/0173345 | A1 | 9/2003 | Irwin, Sr. et al. | 219/212 |
| 2003/0234245 | A1 * | 12/2003 | Cogan | 219/209 |
| 2005/0109752 | A1 * | 5/2005 | Merk et al. | 219/212 |
| 2005/0263518 | A1 | 12/2005 | Weiss | 219/482 |
| 2006/0196868 | A1 * | 9/2006 | Yang | 219/505 |
| 2007/0280655 | A1 * | 12/2007 | Chaput | 392/436 |

OTHER PUBLICATIONS

Kruger, A., "*What is a resettable (PPTC) fuse, and how does it work?*" 2004, http://old.iihr.uiowa.edu/~hml/people/kruger/Publications/ChipCenter/pptc01.pdf (no longer active).

* cited by examiner

HEATER WIRE SAFETY CIRCUIT

CROSS-REFERENCE TO RELATED APPLICATIONS

This application is related to U.S. Provisional Application Ser. No. 61/458,668, which was filed on Nov. 29, 2010, and is entitled "Heater Wire Safety Circuit", and U.S. Provisional Application Ser. No. 61/516,802, which was filed on Apr. 8, 2011, and is entitled "Heater Wire Safety Circuit", the disclosure of each of which is hereby incorporated by reference and on which priority is hereby claimed.

BACKGROUND OF THE INVENTION

1. Technical Field

The technical field includes all electrical heating and safety systems, particularly heating pads and electric blankets that include safety systems for overheat protection under abnormal use conditions.

2. Description of the Prior Art

Electric heating pads are put through numerous abnormal conditions by consumers. To ensure their safety, an overheat safety protection element is commonly included. It is not uncommon for a consumer to unintentionally abuse the product by bunching, twisting and folding the product. While heating pads or electric blankets need to meet consumer demands with faster preheats, higher temperatures and improved comfort, they also need to meet safety requirements with safety circuits and smart wire construction.

Modern flexible heating wire, such as used in electric blankets and heating pads, senses the wire temperature and provides a feedback signal to the control to control both the temperature and safety of the product. The present inventor has several inventions in the area of temperature control and safety of flexible heating wire that use the characteristics of the wire in combination with an electronic control circuit to accomplish temperature control and safety. Weiss U.S. Pat. No. 5,861,610 discloses a heater wire for use in a heating pad and electric blanket, which heater wire includes a sensor wire. An electronic control senses the resistance change with temperature of the sensor wire, and the electronic control also looks for a voltage indicating a meltdown of the inner insulation. Keane U.S. Pat. No. 6,222,162 discloses an electric blanket having a heater wire, and a control that measures the resistance change of the heater wire using a series resistor without a separate conductor. Though the method disclosed in the aforementioned Keane patent can sense the average temperature of the wire, it is limited because hot spots due to bunching or abnormal folding are not sensed. Gerrard U.S. Pat. No. 6,310,332 discloses a heating blanket which uses a combination of a low melt NTC (negative temperature coefficient) layer and a series resistor to control and sense hot spots. The heater wire is powered under one-half (½) cycles, and the sensor wire looks for current in the other half cycle to sense a wire hot spot. Weiss U.S. Pat. No. 7,180,037 discloses a heater wire and control for use in a heating pad and electric blanket that use a separate sensor wire and an NTC layer between the sensor wire and heater wire that conducts current when the first insulation layer becomes hot and also monitors the temperature of the heater wire itself. Temperature sensing of both the NTC layer and the heater wire is accomplished without a series resistor by a phase shift measurement. Systems that include an NTC (negative temperature coefficient) polymer as the insulator for both the function of the circuit and program (software) involved in the safety aspects of the control utilize analog circuits and a microcontroller. Multiple critical components are often identified whose tolerance and manufacturer supply are specified. The failure mode analysis is based on the accumulated failure rates of these multiple critical components, including the microprocessor and solid state switches, such as triacs. The more components that contribute to the safety circuit result in a shorter time between failures. The ingenious circuits that have a reduced number of critical components and also provide improved wire fault detection have led to the success of "smart wire" systems. The disclosures set forth in each of the above-identified patents are incorporated herein by reference.

The extensive approval process in combination with diverse product offering and a short technology life cycle has hampered the cost effectiveness of introducing new technology, i.e., a heating pad or electric blanket having a different shape and wattage approved on an individual model basis is expensive and the approval process is lengthy. Layers of redundant safety systems come at a price, although the reliance on sophisticated electronics is a safety improvement over the traditional mechanical thermostat systems. The consumer is not always willing to pay additional for features that are transparent, resulting in the less reliable mechanical temperature control products that are still evident in today's lowest cost heating pads.

OBJECTS AND SUMMARY OF THE INVENTION

It is an object of this invention to provide a simple, low cost system to regulate the temperature of products that employ flexible heater wire and to passively interrupt the power to the heater wire when a fault or over-temperature condition exists at any location along the length of the wire.

It is another object of the present invention to provide a heating pad and electric blanket that overcomes the inherent disadvantages of conventional heating pads and electric blankets.

In accordance with one form of the present invention, a heater wire safety circuit for use with an electric blanket or heating pad includes a heater conductor to provide heat to the electric blanket or heating pad over at least a portion thereof. A low resistive conductor is situated in proximity to the heater conductor along at least a portion of the length of the heater conductor. A low melt insulate layer is situated between the heater conductor and the low resistive conductor along at least a portion of the length of the heater conductor. The resistance of the low resistive conductor is much less than that of the heater conductor.

In one embodiment of the safety circuit, a pair of diodes are connected between the heater conductor and the low resistive conductor, one diode being situated at one end of the heater conductor and low resistive conductor, and the other diode being situated at the other end of the heater conductor and low resistive conductor, with the diodes being oriented so that no current normally flows through the low resistive conductor. However, if a hot spot occurs in the electric blanket or heating pad anywhere along the length of the heater conductor situated within the electric blanket or heating pad which exceeds a predetermined temperature, the low melt insulate layer will melt at that hot spot so that the heater conductor and low resistive conductor contact each other. The low resistance of the low resistive conductor will short out the higher resistance of the heater conductor to conduct more current through the low resistive conductor than is normal. This will cause a fuse connected to the heater conductor to open, thereby preventing further current from flowing into the electric blanket or heating pad.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 13:
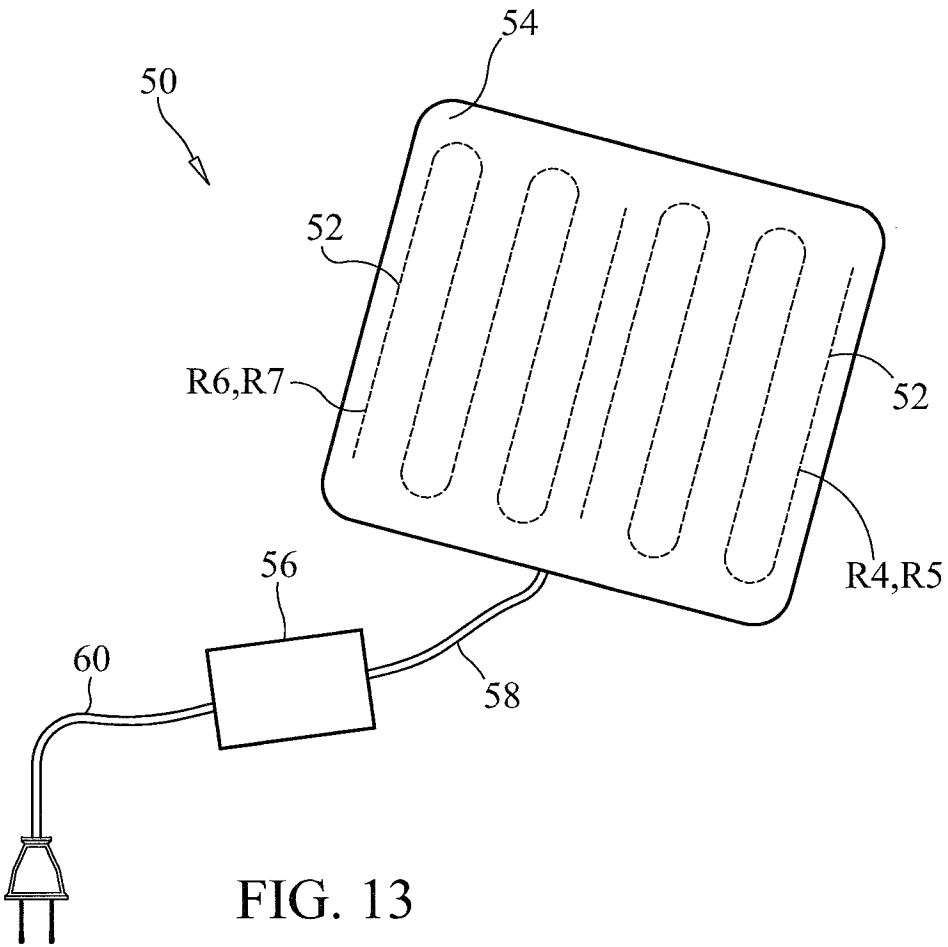
FIG. 13 is a perspective view illustrating a heating pad or electric blanket formed in accordance with the present invention.

Referring initially to FIG. 13 of the drawings, it will be seen that a heating pad or electric blanket 50 formed in accordance with the present invention includes an elongated heater wire 52 also formed in accordance with the present invention, within an outer covering 54, which is preferably formed of cloth. A control unit 56, also referred to herein as a "control", is operatively coupled to the heater wire 52 to control the power provided to the heater wire and thus the temperature of the heating pad or electric blanket 50. This control unit 56 may be connected to the heating pad or electric blanket by a control cord 58 having one or more electrical wires, the control cord 58 being separate from the power cord 60 providing 120 volts AC power to the heater wire 52 within the heating pad or electrical blanket 50. Alternatively, the control unit 56 may be electrically connected to the power cord 60, with the 120 volts AC power being provided to the heating pad or electric blanket 50 by wires within the control cord 58 connected to the heating pad or electric blanket 50, as shown in FIG. 13. Portions of heating wire safety circuit of the present invention, as will be described in greater detail, may be incorporated in the control unit 56, or may be incorporated directly within or at the heating pad or electric blanket 50.

Figure 11:
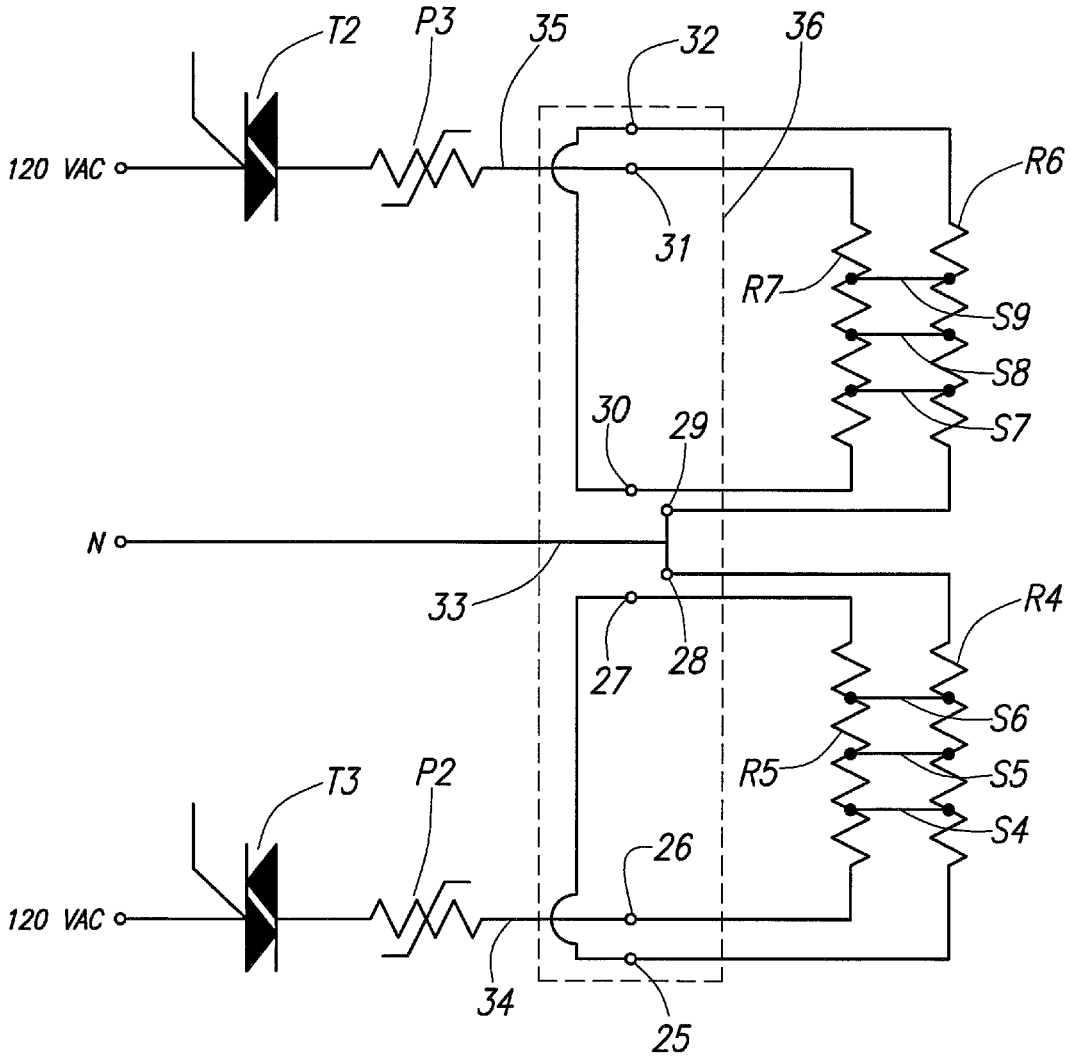
FIG. 11 is a schematic diagram of a dual circuit heater circuit formed in accordance with a preferred embodiment of the present invention.

The heating pad or electric blanket 50 shown in FIG. 13 is depicted with two heater circuits having heater wires 52, such as shown schematically in FIG. 11, where one heater wire 52 has two heater conductors 1', 3' having resistances R4 and R5 (see FIG. 11), and the other heater wire 52 also has two heater conductors 1', 3' having resistances R6 and R7.

Figure 1:
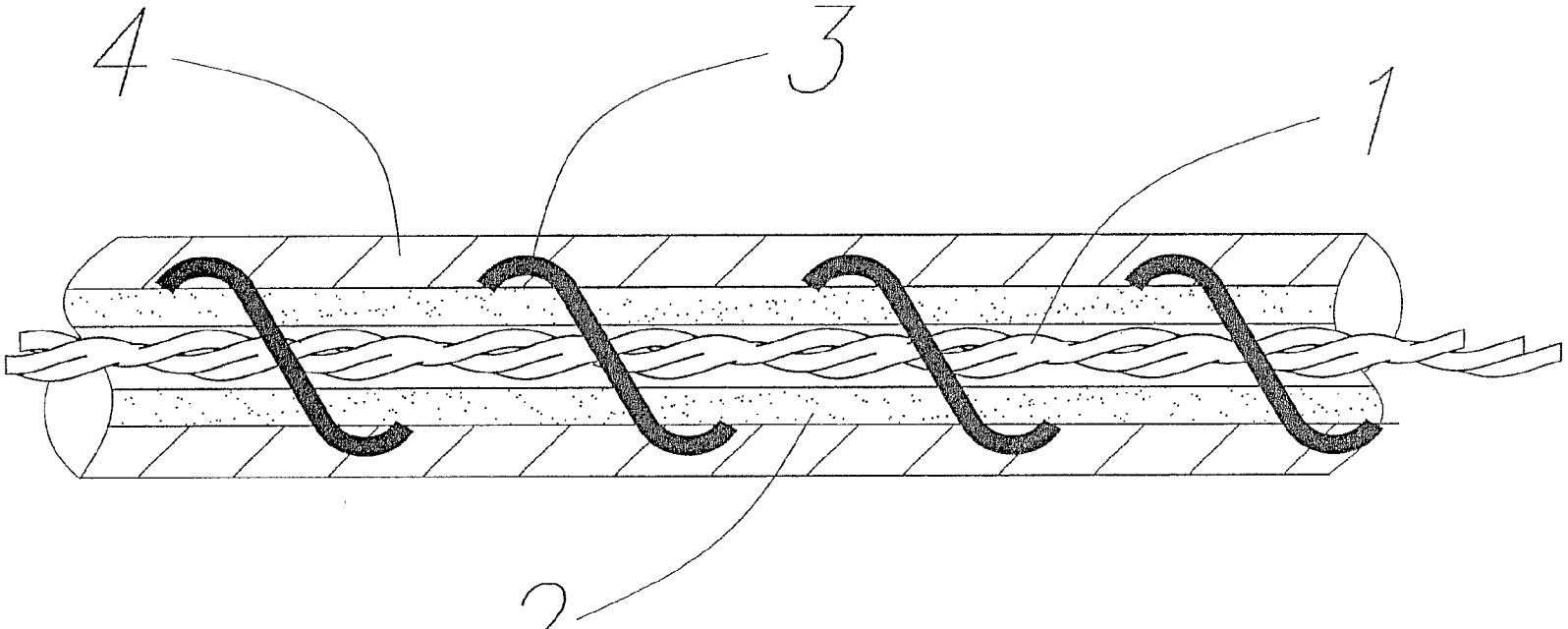
FIG. 1 is a constructional perspective view of the wire used in the present invention.

Referring now to FIG. 1, and in accordance with the present invention, it will be seen that an elongated heater wire 52 is constructed having a Copper tinsel core 1. The tinsel core 1 is comprised of multiple ribbon strands for flexibility and to have a low resistance value. The core is preferably on the order of about 0.8 ohms (Ω) per meter. Surrounding the tinsel core is extruded a low melt polymer insulate layer 2, such as polyethylene, that has a melting point of preferably about 130° C. Wound around the low melt insulate layer 2 is a heater conductor 3, made from a metal or alloy having a high change of resistance with temperature. This property is known as the coefficient of thermal resistance, or thermal coefficient resistance (TCR). Nickel (95%) exhibits a TCR of 0.5% per ° C. Copper is also suitable, having a TCR (thermal coefficient resistance) of 0.39% per ° C. Outside the heater conductor is extruded the outer insulation 4 preferably made of flexible polyvinylchloride (PVC). The heater wire is sized to provide heat when current is applied. As the temperature of the heater conductor 3 increases, the resistance also increases; the overall resistance of the heater conductor 3 is an indication of the temperature of the wire. This type of wire is available from Thermocable LTD in the U.K. and is designated Model No. TD500.

Figure 2:
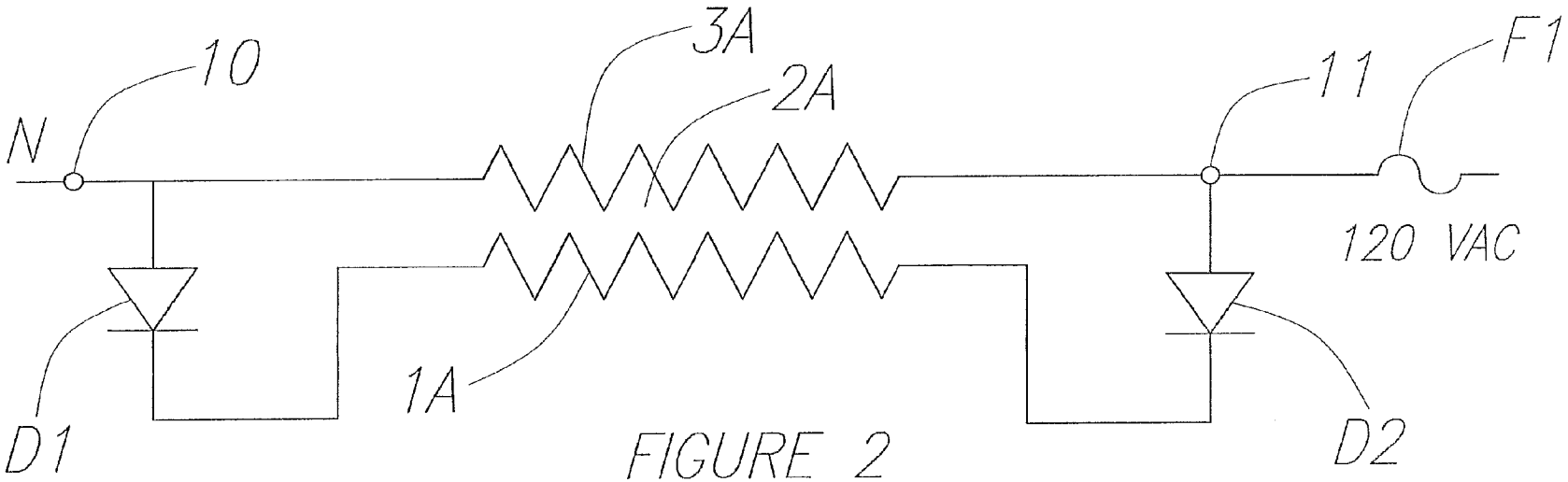
FIG. 2 is a schematic diagram of the wire configuration of a single circuit powered by full wave AC line voltage formed in accordance with the present invention.
Figure 4:
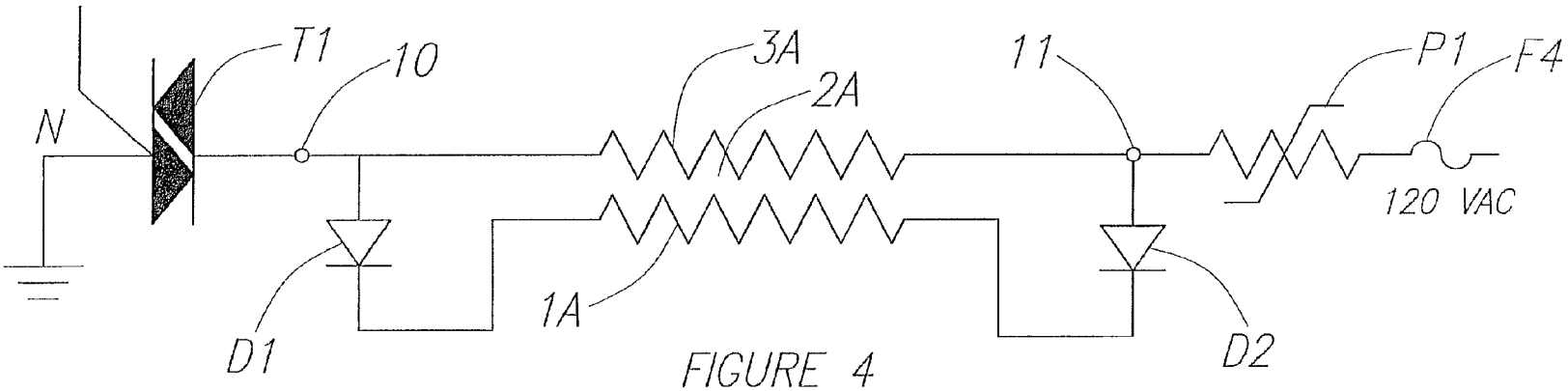
FIG. 4 is a schematic diagram of a safety overheat protection circuit formed in accordance with the present invention and including switching and limiting components.

The heater conductor 3 of the wire configuration shown in FIG. 1 may be connected to a circuit that senses an over current condition through the heater conductor, such as a polymetric positive temperature coefficient (PPTC) device, such as device P1 shown in FIG. 4, or a fuse, such as fuse F4 shown in FIG. 2, to reduce or prevent (by using a triac, such as triac T1 shown in FIG. 4, or another switching device or circuit) the flow of current through the heater conductor. Alternatively, a sensing resistor, such as resistor R10 in FIG. 12, may be used in series with the heater conductor 3. The voltage across the sensing resistor may be sensed by a microprocessor or comparator and compared to a reference voltage to determine if an over current condition through the heater conductor exists.

Figure 3:
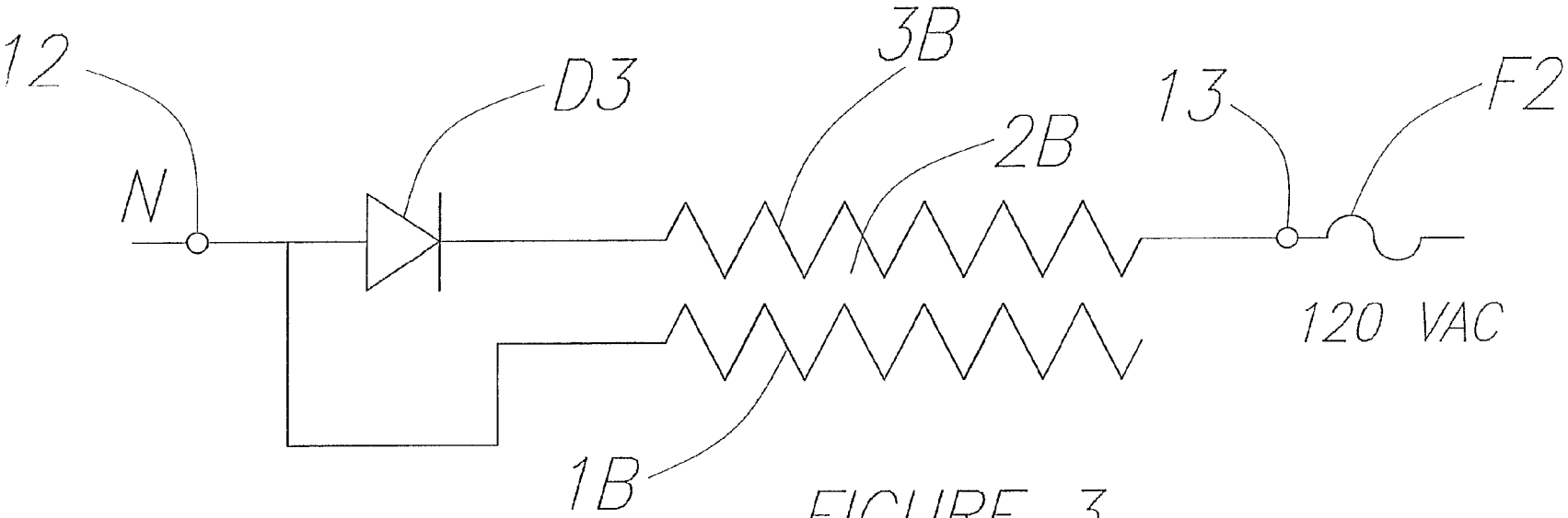
FIG. 3 is a schematic diagram of the wire configuration of a single circuit powered by half wave AC line voltage foamed in accordance with the present invention.

Schematically, the wire can be configured several ways as illustrated in FIG. 2 and FIG. 3. First, consider the configuration of FIG. 2, where reference number 3A represents the heater conductor 3 and reference number 1A represents the low resistive core 1. The low melt insulate layer 2A is shown as a space between the heater conductor 3A and resistive core 1A. Two diodes, D1 and D2, at opposite ends of the heater conductor 3A and low resistive conductor core 1A, connect both conductors 3A, 1A in polar opposite directions, i.e., connected cathode to cathode through core 1 (1A), as shown in FIG. 2, or anode to anode through core 1 (1A). Under normal conditions with AC voltage applied across the heater conductor 3A located between the neutral (N) power line at node 10 and the 120 VAC (hot) power line at node 11, the diodes D1 and D2 block current in both the first and second half cycles, isolating the core 1A and the heater conductor 3A. The low melt insulate layer 2, shown in FIG. 1, or 2A in FIG. 2, is preferably about 0.015" thick, and provides adequate electrical insulation under normal conditions; however, should any section of the low melt insulate lay 2 (2A) overheat to a temperature of 130° C., then it will melt and allow the heater conductor 3A to move and touch the low resistive core 1A, effectively creating a short across both isolating diodes D1 and D2. Since the resistance of core 1A is negligible compared to the resistance of heater conductor 3A, preferably on the order of about 1/200 as a ratio of their resistances, the current through the parallel arrangement of the heater conductor 3A and the low resistive core 1A will increase by at least two times. In the simplest form of the circuit, a fuse F1 in series with the 120 VAC power line is sized to open with higher than normal current. In FIG. 2, the letter "N" represents the neutral wire.

Alternatively, the heater conductor 3B can be powered by half cycle, schematically illustrated in FIG. 3. In this case, the diode D3 is connected in series at its cathode (or, alternatively, its anode) with one end of the heater conductor 3B. The other end of the heater conductor 3B is connected at node 13 to fuse F2. The anode (or, alternatively, the cathode) of diode D3 is connected to the neutral (N) power line and to one end of the low resistive core 1B, whose other end is open (not connected to the circuit). As in the embodiment shown in FIG. 2 and described previously, heater conductor 3B is separated from low resistive core 1B by a low melt insulate layer 2B.

The diode D3 is shunted as the low melt insulate layer 2B melts and shorts at any place along the heater conductor 3B between the heater conductor 3B and the low resistive core 1B, wherein the current at least doubles, and as described above, will open the fuse F2 in series with the 120 VAC power line. The advantage of this arrangement over the circuit of FIG. 2 is when long length heater wire is used. Should the meltdown of the low melt insulate layer 2B occur near the neutral side N, close to the diode D3, then the current doubles by introducing the negative half cycle. If the meltdown of the low melt insulate layer 2B occurs farther toward the high voltage 120 VAC end at node 13, then the current more than doubles as the low resistive core 1B also shunts the heater conductor 3B on the neutral (N) side at node 12 of the meltdown. Electric blankets typically have 23 to 30 meters of heater wire and would benefit from this arrangement.

FIG. 4 illustrates a more complete arrangement of the circuit of the present invention schematically shown in FIG. 2 that employs a solid state switch (e.g., a triac) T1 connected in series between the neutral (N) power line and node 10, and a Polymetric Positive Temperature Coefficient device P1 connected in series between fuse F4 in line with the 120 VAC power line and node 11. The Polymetric Positive Temperature Coefficient device P1 is otherwise known as a PPTC device, as it will be referred to hereinafter. This PPTC device P1 acts as a resettable fuse. The fuse F4 in this case is preferably sized greater than about two times the normal current, and the PPTC device P1 is preferably sized to enter the high resistance state with less than two times the normal current. This arrangement will survive short transient current surges and also the higher current that is typical upon startup of the positive resistance change of the heater conductor 3 (3A in FIG. 4). A solid state switch, such as a triac T1, is controlled by a control circuit within control unit 56, and switches off (or on) the power to the heater wire supplying 120 VAC across the heater conductor 3A based on the temperature of the heater conductor, pad or blanket. As the heater conductor 3A heats, the resistance thereof increases and the current decreases until a steady state current is reached. The PPTC device P1 remains in a current hold state having low resistance. If the heater wire is bunched and subsequently heat builds up at the point of the bunch, such as an insulated overlapping wire condition, a meltdown of the insulate layer 2A occurs and the heater conductor 3A shorts to the low resistive core 1A, causing the current to at least double. Within a few seconds, the PPTC device P1 will change state to a high resistance. The current is thereby substantially reduced yet is sufficient to keep device P1 in a high impedance state. The PPTC device P1 is sized according to a hold current and a trip current. The trip current of the PPTC device P1 needed to change the device P1 from a low resistance state to a high resistance state is typically about two times the aforementioned hold current. The hold current is the current required to maintain the PPTC device P1 in a low resistance state. A wire temperature sensing circuit (not shown), which may be situated within control unit 56, and having a sensing wire or resistor (also not shown) within the heating pad or electric blanket 50, in the case of a short will continue to trigger the triac T1, ensuring that the PPTC device P1 will soon transform into a high impedance state, going from, for example, 0.5 ohms to 4K ohms. The heating pad or electric blanket 50 incorporating the safety circuit of the present invention will then no longer produce noticeable heat and the hot spot will cool. The advantage of this method of hot spot detection is that a very small percentage of the heater conductor 3A that overheats will cause the tripping of the PPTC device P1. Another advantage is that the hot spot detection and subsequent reduction of power to the heater conductor 3A are independent of the control circuit of unit 56 (including the wire temperature sensing circuit) for the heating pad or electric blanket 50. Regardless of any failure of the control circuit of unit 56 that may occur, the safety circuit of the present invention as described will limit the power to the heater conductor 3A upon an overheat condition any place along the entire length of the conductor 3A. Only two junctions 10 and 11 are required to connect the control circuit within unit 56 to the heater conductor 3A. The diodes D1 and D2 are preferably located within the heating pad or electric blanket 50, typically in the connector at the electric blanket or pad 50 which connects the control cord 58 thereto. Therefore, the control cord 58 to the product becomes a two wire connection. Other "smart wire" circuits such as were previously described in the Background section require three or four wires to connect the control circuit to the heating pad or electric blanket.

Figure 5:
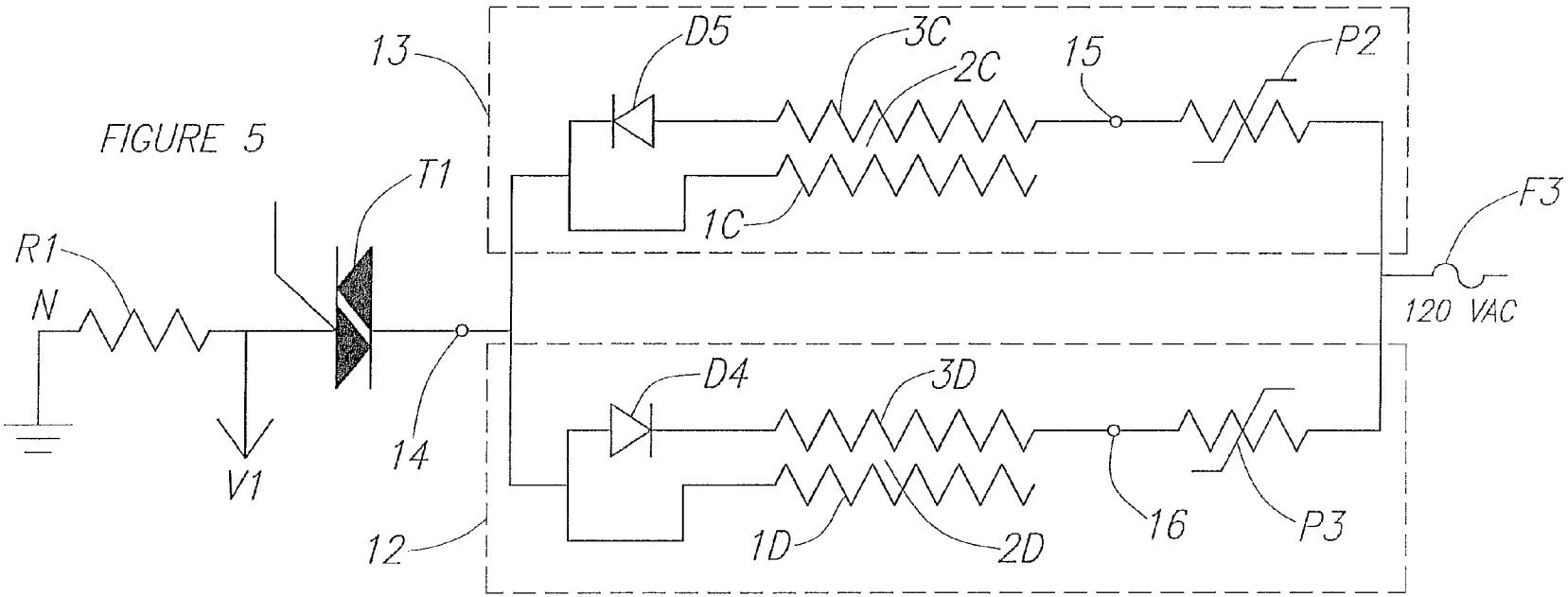
FIG. 5 is a schematic diagram of a dual heater circuit, having a series resistor for monitoring the heater temperature, formed in accordance with the present invention.

An example of a dual temperature and safety circuit of the present invention is shown in FIG. 5. Several temperature control methods can be used and are not relevant to the operation of the safety circuit. For simplicity, the schematic of FIG. 5 is shown with a series resistor R1 interposed between the neutral (N) power line and a triac T1 connected to node 14 of the dual circuit. Node 14 is connected to the cathode of diode D5 of the second heater circuit 13 and to the anode of diode D4 of the first heater circuit 12. The anode of diode D5 of the second heater circuit 13 is connected to one end of heater conductor 3C, whose other end is connected to node 15. The cathode of diode D5 is connected to one end of the low resistive core 1C, whose other end is open-circuited. Low melt insulate layer 2C separates the heater conductor 3C from the low resistive core 1C when the second heater circuit 13 is operating normally.

Similarly, in the first heater circuit 12, the triac T1 is connected at node 14 to the anode of diode D4, whose cathode is connected to one end of heater conductor 3D. The other end of heater conductor 3D is connected to node 16. The anode of diode D4 is connected to the low resistive core ID, whose other end is open-circuited. Low melt insulate layer separates the heater conductor 3D from the low resistive core 1D when the first heater circuit 12 is operating normally.

The voltage V1 across the series resistor R1 decreases as the impedance of the heater conductors 3C and 3D increases. Two circuits are shown, 12 and 13, both of which are powered by opposite half cycles, the first heater circuit 12 being similar to the embodiment shown in FIG. 3 and powered by the first half cycle, and the second heater circuit 13 also being similar thereto but with the diode D5 reversed to the diode D4 of the first circuit 12 so as to be powered by the second half cycle. A single triac T1 is triggered to switch the power on both heater conductors 3D and 3C. Thus, heater conductor 3C of the second circuit 13 is powered in the second half cycle, and heater conductor 3D of the first circuit 12 is powered in the first half cycle, with series diodes D4 and D5 in series with the conductor wires 3D and 3C, respectively.

In this arrangement, two PPTC devices P3 and P2 are used, one device in each circuit 12, 13, and one fuse F3, although two separate fuses can be used, one for each circuit 12, 13. More specifically, one PPTC device P3 in the first heater circuit 12 is connected between node 16 and fuse F3. The other PPTC device P2 in the second heater circuit 13 is connected between node 15 and fuse F3. The other end of fuse F3 is connected to the 120 VAC power line. The control logic of the control circuit of unit 56 can be independent or can be based on the hottest of circuits 12, 13. If both circuits 12, 13 are the same temperature, then the temperature control circuit will allow the most power to a heater circuit regardless of the imbalance of the heater load. For example, if one circuit 12 or 13 is insulated, and the other circuit 13 or 12 is not, then the power is reduced according to the hottest, insulated side. The voltage is monitored across resistor R1 for each half cycle by the control circuit in unit 56. When the voltage across resistor R1 goes below a threshold differential in either half cycle, then the triac T1 is turned off, reducing heat to the pad or blanket 50. Periodically, the triac T1 is turned on to sense the resistor R1 voltages. If for opposite half cycles the voltages across resistor R1 are both over a predetermined threshold, then the triac T1 is switched back on and both circuits 12, 13 heat. If a hot spot occurs anywhere along the heater conductor 3D and low resistive core 1D of circuit 12, then the PPTC device P3 will go to a high impedance state. Concurrently or independently, should a hot spot occur anywhere along the heater conductor 3C of the other circuit 13 and a short occurs between heater conductor 3C and low resistive core 1C, then the PPTC device P2 will go into a high impedance state. Fuse F3 is selected to open at a greater current than the trip current for either PPTC device P2 or P3. In this embodiment, a three wire connection having junction 14 to the power switching side and junctions 15 and 16 to the 120 VAC side is shown. A three conductor control cord 58 leading to the control circuit in control unit 56 is thus used for driving the two separate circuits. Also, the PPTC devices P3 and P2 are preferably located in the external control unit 56, but may be located in the safety circuit situated within the heating pad or electric blanket 50.

Figure 6:
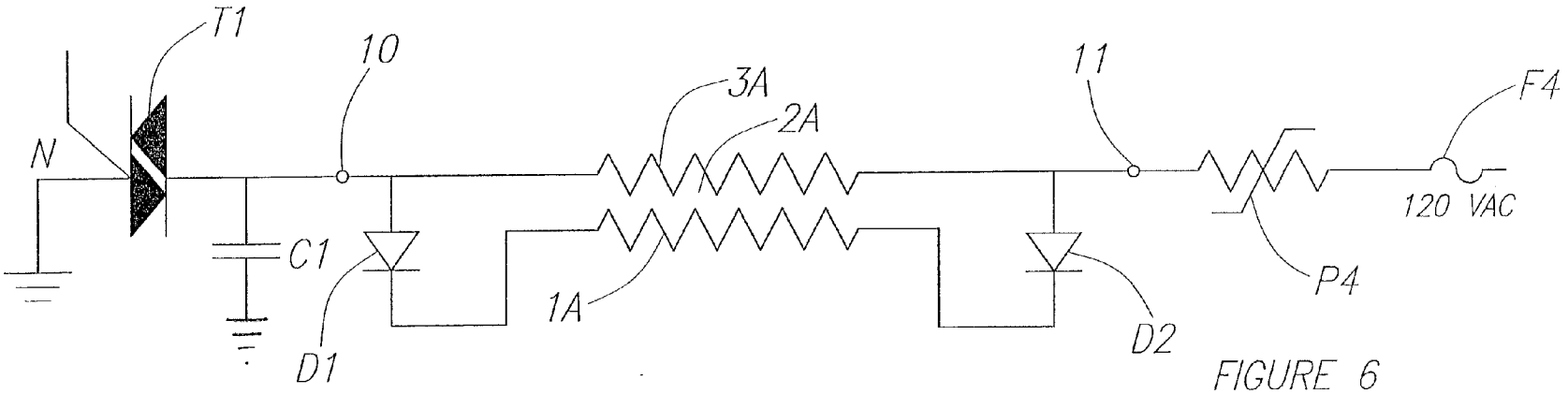
FIG. 6 is a schematic diagram of a single heater circuit having a phase shift capacitor to monitor the heater temperature, formed in accordance with the present invention.

Many temperature control methods can be used and the same principles apply. FIG. 6 shows the circuit shown schematically in FIG. 4 that uses a phase shift capacitor C1 coupled between ground (neutral) and node 10 and triac T1 in a voltage divider arrangement with the heater conductor 3A. As the temperature of the heater wire 3A increases, the phase of the zero crossing at node 10 increases relative to the input power zero crossing. This method is described in detail in Weiss U.S. Pat. No. 7,180,037 mentioned previously, the disclosure of which is incorporated herein by reference. If any hot spot occurs along the heater conductor 3A and low resistive core 1A that causes the insulate layer 2A to melt, a short in turn causes the PPTC device P4 (P2 in FIG. 4) to trip irrespective of the control system used. The advantage of using a phase detection method in combination with the present safety circuit invention described herein over the series resistor method of the embodiment shown in FIG. 5 is that the capacitor circuit will not produce heat that affects the trip point of the PPTC device P4; however, tolerances of the trip point in either control method of the embodiments shown in FIG. 5 and FIG. 6 are well within the working range.

Referring again to FIG. 4 and the case where the hot spot and resulting short is at either end of the heater conductor 3A, a high current will exist and may exceed the maximum current of the PPTC device P1 or triac T1 before the fuse F4 opens. Also, if either of diodes D1 or D2 fails to open or is poorly soldered, the current increase may not be enough to trip device P1. For a product such as heating pads or electric blankets 50 with production volumes in the millions, component and workmanship failures need to be considered. The diode circuit of the present invention illustrated in FIG. 7 solves both the problem of over current and component failure.

Figure 7:
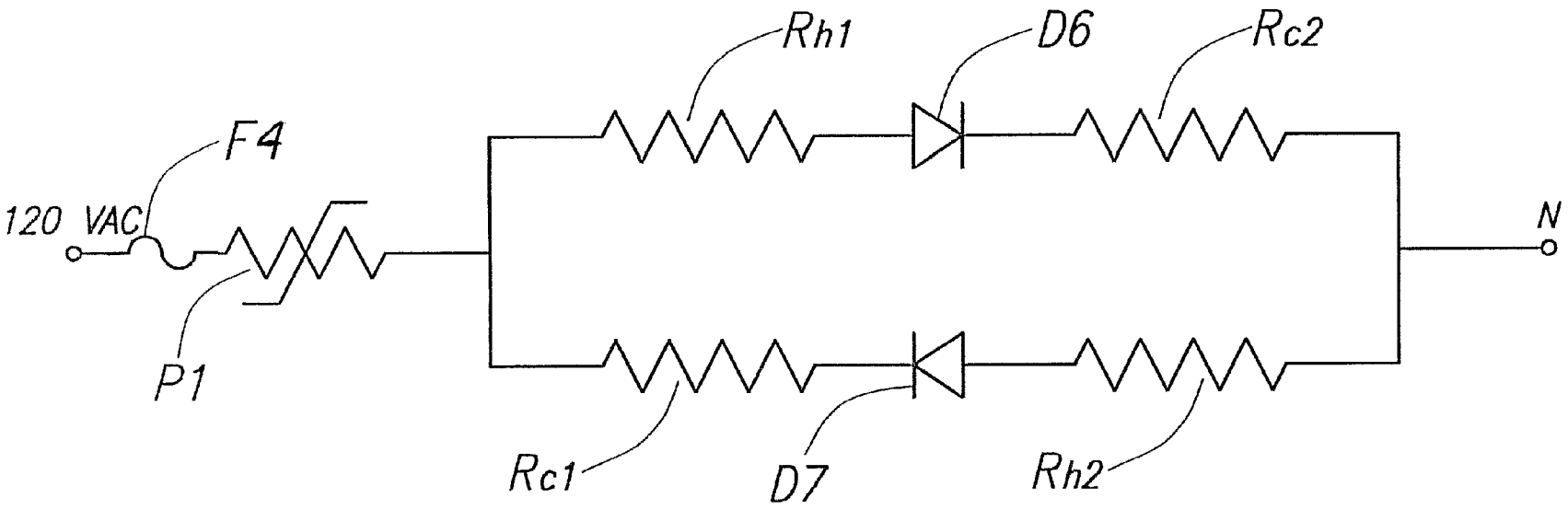
FIG. 7 is a schematic diagram of a single circuit with a pair of shifting diodes between the heater and core, formed in accordance with the present invention.

The diode pair in the circuit of FIG. 7 is located preferably in the middle of the heater wire. The heater conductor Rh1 of the first half of the heater wire is connected through diode D6 to the low resistive core Rc2 of the opposite second half of the heater wire, and the heater conductor Rh2 of the second half is connected through diode D7 to the low resistive core Rc1 of the first half of the heater wire.

More specifically, the 120 VAC power line is connected through a fuse F4 to one end of a PPTC device P1, whose other end is connected to a first end of the first half section Rh1 of the heater conductor 3. The second end of the first half section Rh1 of the heater conductor 3 is connected to the anode (or, alternatively, the cathode) of diode D6 preferably placed in the middle of the length of the heater conductor 3. The cathode (or, alternatively, the anode) of diode D6 is connected to a first end of the second half section Rc2 of the low resistive core. The second half section Rh2 of the heater conductor 3 is wrapped about the second half section Rc2 of the low resistive core 1 and separated therefrom by the low melt insulate layer 2. Similarly, the first half section Rh1 of the heater conductor 3 is wrapped about the first half section Rc1 of the low resistive core 1 and separated therefrom by the low melt insulate layer 2.

The second end of the second half section Rc2 of the low resistive core 1 is connected to the neutral (N) power line, which is also connected to the first end of the second half section Rh2 of the heater conductor 3. The second end of the second half section Rh2 of the heater conductor 3 is connected to the anode (or, alternatively, the cathode) of diode D7 preferably also placed in the middle of the length of heater conductor 3, like diode D6. The cathode (or, alternatively, the anode) of diode D7 is connected to the first end of the first half section Rc1 of the low resistive core 1. The second end of the first half section Rc1 of the low resistive core 1 is connected to the PPTC device P1 and to the first end of the first half section Rh1 of the heater conductor 3.

Because the resistances of heater conductor sections Rh1 and Rh2 are substantially higher than the resistance of the core sections Rc1 and Rc2, as previously described, the current is effectively doubled for a short at any location along the heater wire, and an over current condition is thus avoided. An open heater wire, core or diode can be detected, as no current exists in either the positive or negative half cycle.

Figure 8:
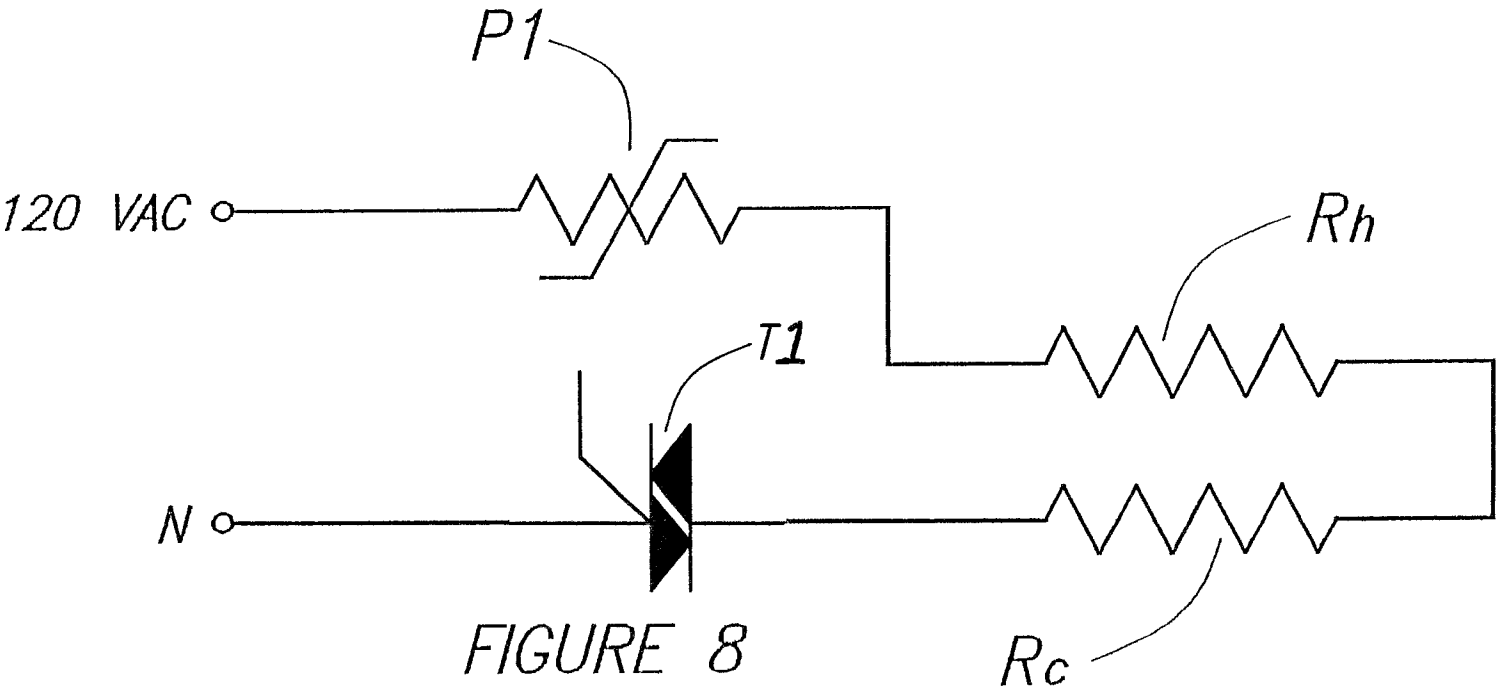
FIG. 8 is a schematic diagram of a single heater circuit with the heater conductor and core connected, formed in accordance with the present invention.

FIG. 8 shows an even simpler form of a heater wire safety circuit than that shown in FIG. 7. The heater conductor Rh is connected at a first end to one side of a PPTC device P1, whose other side is connected to the 120 VAC power line. The second end of the heater conductor Rh, near the far end of the heater wire opposite the 120 VAC power line, is connected to the first end of the low resistive core Rc, whose second end is electrically coupled to the neutral (N) power line preferably through a triac T1 or other switching device. The heater conductor Rh is wrapped about the low resistive core Rc over the length of the heater wire, and separated therefrom by the low melt insulate layer 2A. Thus, the heater conductor/resistive core connection is located at the far end of the heater wire.

Consider a hot spot short near the end of the wire, near where the line shown in FIG. 8 connects the heater conductor Rh and the core Rc together. In such a situation, the current will increase incrementally but will not increase enough to cause the PPTC device P1 to switch to a high resistance state; however, the short will cool the hot spot. In this case, the trip point of device P1 is designed to be just above the normal current of the heater conductor Rh. If the heater wire was controlled by the PTC effect of the heater conductor Rh, then the temperature of the effectively shorter wire would be out of tolerance. Also, a short near the beginning of the heater wire (to the left when viewing FIG. 8) will cause a high current that would exceed the maximum current of the device P1 and also the switching device, such as the triac T1 as described, or even a thermostat. The application of this circuit would therefore be limited. The elimination of the diode connections such as found in the embodiments shown in FIG. 8 would in this case be the only advantage outweighed by the disadvantages just described.

Figure 1A:
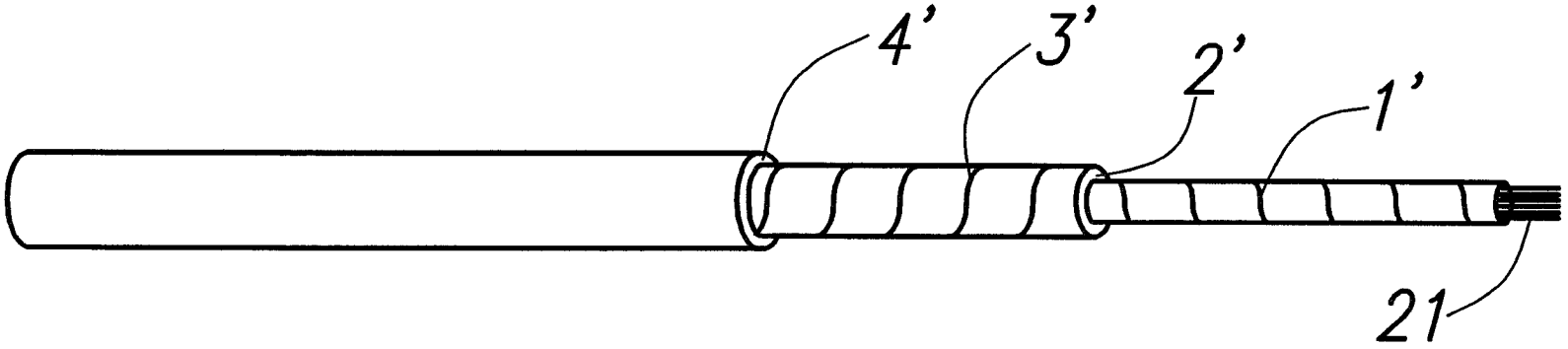
FIG. 1A is a constructional perspective view of an alternative version of the wire used in the present invention.
Figure 9:
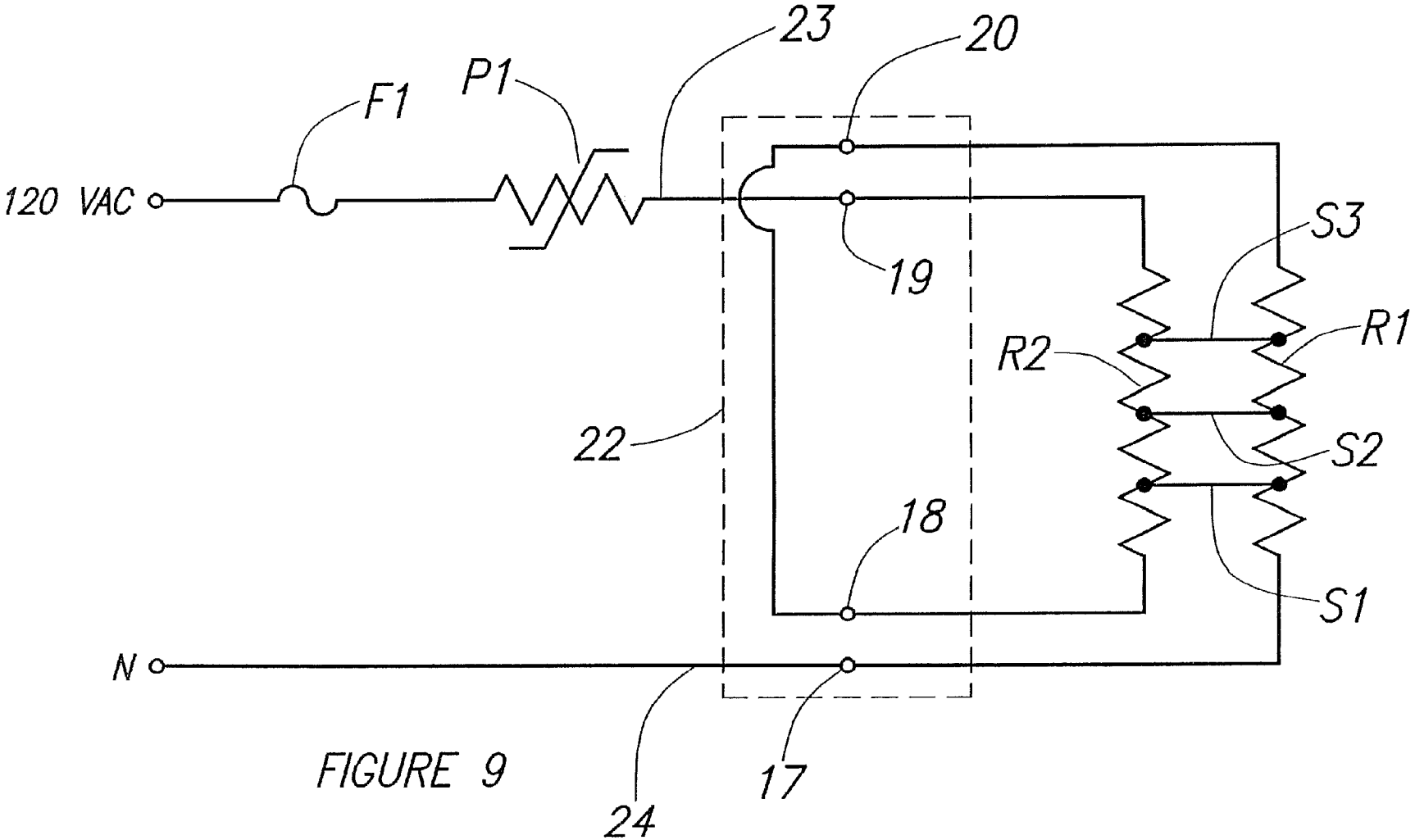
FIG. 9 is a schematic diagram of another preferred embodiment of the safety overheat protection circuit, with the core connected to the heater circuit in opposite polarity.

The heater wire safety circuit of the present invention shown in FIG. 9 in combination with the heater wire construction illustrated in FIG. 1A are herein described by way of example.

As shown in FIG. 1A, the heater wire of FIG. 1 is constructed by winding a first heater conductor 1' around a fiber core 21. A low melt insulate layer 2' is then extruded over the inner assembly fiber core 21 and conductor 1'. A second heater conductor 3' is counter-wound over the low melt insulate layer 2' in the opposite direction to the winding of the first heater conductor 1'. An outer insulative layer 4', preferably formed of polyvinylchloride (PVC), is then extruded over the dual heater wire assembly. A hot spot anywhere along the length of the heater wire will cause the low melt insulate layer 2' to melt and the conductors 1' and 3' to contact each other and short. The heater conductors 1' and 3' are made of a metal or alloy having a consistent temperature coefficient of resistance along their length, providing a feedback characteristic relative to the average temperature of the wire for temperature control. During normal use, the temperature of the entire heater wire will be controlled to a predetermined value. In an abnormal use condition, where the heater conductors are bunched or overlapped and insulated, the temperature of the bunched portion will rise above the average temperature until it reaches the melt temperature of the low melt insulate layer 2', which is selected preferably to be approximately 120° C., and the two heater conductors 1' and 3' make contact with each other. In the same or similar manner as described with respect to the heater wire shown in FIG. 1, one or both of the heater conductors 1' and 3' of the wire configuration shown in FIG. 1A may be connected to an over current sensing circuit (e.g., a fuse, PPTC device, sensing resistor, microprocessor or comparator), such as described, to reduce or prevent (such as by using a triac or other switching device or circuit) the flow of current through the heater conductor 1', 3'.

FIG. 9 shows the heater wire of FIG. 1A in schematic form with the inner heater conductor 1' represented by resistor R1 and the outer heater conductor 3' represented by resistor R2. The twin heater conductors 1' and 3' are connected in series at opposite ends (end-to-end) so that a voltage potential exists between the conductors at any point along the wire. To facilitate this discussion of the preferred configuration shown in FIG. 9, the heater conductors having resistances R1 and R2 are assumed to be of the same resistance value and are in a series relation. The combined resistance of conductors having resistances R1 and R2 comprises the normal resistance of the heater element. A connector or printed circuit board 22 provides the attachment of both heater conductors 1', 3' to the power supply conductors 23 and 24. A PPTC device P1 and fuse F1 are connected to each other in series, with the fuse F1 being also connected to the 120 VAC power line, and the PPTC device P1 being also connected to an end of the outer heater conductor 3' (i.e., resistance R2).

More specifically, in accordance with a preferred form of the present invention, and referring to FIG. 9 of the drawings, it will be seen that the 120 VAC power line 23 is connected through fuse F1 to PPTC device P1, which in turn is connected at node 19 on the printed circuit board 22 or connector to first end of the outer heater conductor 3' having resistance R2. The second end of the outer heater conductor 3' is connected at node 18 on the printed circuit board 22 or connector. Node 18 is connected to node 19 on the printed circuit board 22 or connector, to which is connected the first end of the inner heater conductor 1' having resistance R1. The second end of the inner heater conductor 1' is connected to node 17 on the printed circuit board 22 or connector, which is also connected to the neutral power line 24. Preferably, the fuse F1 and the PPTC device P1 are located within the control unit 56, and are in series with the twin conductor heating element.

Still referring to FIG. 9, the low melt layer 2' is shown as the space between conductors 1' and 3' respectively having resistances R1 and R2, and a melt or short is shown by lines S1, S2 and S3 at locations of 25%, 50% and 75% along the length of the heater wire. By way of example, values of resistances R1 and R2 of conductors 1' and 3' are both 87.75Ω each and 175.5Ω at room temperature, 20° C. When 120 VAC power is applied, the heater conductors 1', 3' increase in temperature and the resistance values increase due to the positive temperature nature of the conductor metal; in this case, a Nickel alloy is preferably used, having a temperature coefficient of resistance of 0.45% per ° C. A 100° C. increase in temperature would result in the total resistance (R1+R2) of conductors 1' and 3' increasing by 45%, or 175.5×1.45=254.47, at 120° C.

Consider a heating pad having the twin conductor heater wire of FIG. 1A designated in FIG. 9 by resistors R1 and R2, and with the space between conductors 1' and 3' (resistances R1 and R2) representing the low melt insulate layer 2'. Due to abnormal use and local overheating, a short occurs in the wire between conductors 1' and 3' (resistances R1 and R2), and the short is either at 25% along the wire length at location S1, 50% along the length of the wire at location S2, or 75% along the length of the wire at location S3. The current path for a short at point S1 includes 25% of conductor resistance R1 in series with 75% of conductor resistance R2, effectively reducing the resistance by 50% and increasing the current by two times. The same doubling of the current occurs for shorts at locations S2 and S3. The effective resistance values and corresponding fault currents are tabulated in Table 1 shown below. It should be noted that for any short at any point along the length of the heater wire, the current is doubled from 0.68 amps to 1.36 amps at 20° C. In the extreme case of the entire pad operating at 120° C., the conductor 1' resistance R1 and conductor 3' resistance R2 are increased by 45%, as described previously, and the fault current is 0.94 amps for any point along the heater wire. The actual working maximum design temperature of the pad is preferably 70° C. and is well within the startup temperature, room temperature and the extreme temperature of 120° C., which is preferably the low melt layer temperature of the wire. With the current limiting device P1 having a trip point of 0.80 amps, the current is limited for any condition of overheat expected to occur.

TABLE 1

| WIRE TEMPERATURE | NORMAL CURRENT | FAULT CURRENT | R1 Ω (OHM) | R2 Ω (OHM) | TOTAL (OHM) | CONDITION |
|---|---|---|---|---|---|---|
| 20° C. | .68 A | | 87.75 | 87.75 | 175.5 | NORMAL |
| 20° C. | 1.36 A | 1.36 A | 21.93 | 65.81 | 87.75 | Short at S1 |
| 20° C. | 1.36 A | 1.36 A | 43.87 | 43.87 | 87.75 | Short at S2 |
| 20° C. | 1.36 A | 1.36 A | 65.81 | 21.93 | 87.75 | Short at S3 |
| 120° C. | .47 A | | 127.24 | 127.24 | 254.47 | NORMAL |
| 120° C. | .94 A | .94 A | 31.81 | 95.43 | 127.24 | Short at S1 |
| 120° C. | .94 A | .94 A | 63.62 | 63.62 | 127.24 | Short at S2 |
| 120° C. | .94 A | .94 A | 95.43 | 31.81 | 127.24 | Short at S3 |

Figure 10:
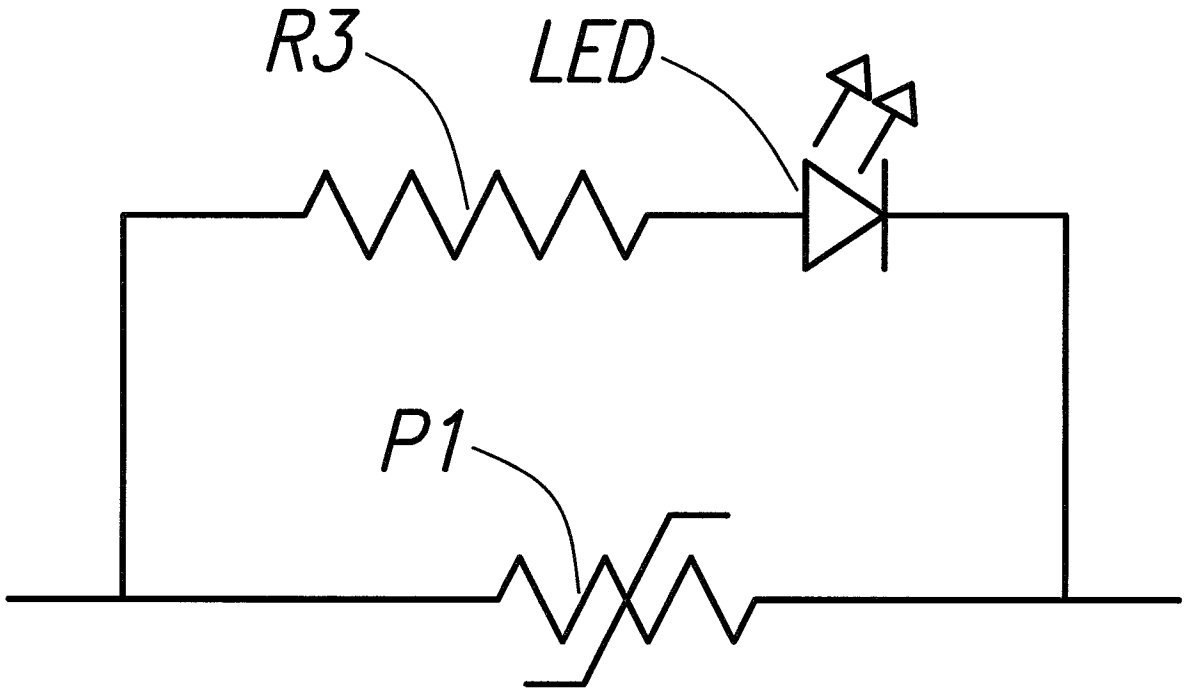
FIG. 10 is a schematic diagram of a fault indicator which may be used in the safety overheat protection circuit (heater wire safety circuit) of the present invention.

It is expected that the fault, or hot spot, will only happen when the heating pad, or electric blanket 50, is used in the abnormal condition and it is bunched or folded and insulated. The user may not be aware that he used the product in a way that was not intended, despite warnings on the label of the product. When a short in the heater wire trips the PPTC device, the voltage across the heater wire is diminished and no apparent heating will be felt by the user. If, however, the pad, or blanket 50, is unplugged or powered off, the PPTC device will reset, and heat will be restored to the product for a short period of time. To alert the user that an abnormal fault condition has caused the safety shutdown, an indicator is preferably used. FIG. 10 shows an automatic fault indicator formed in accordance with the present invention. In the normal heating mode with no wire faults, the current is below the trip current of the PPTC device P1, and the voltage across the PPTC device P1 is less than about 1 volt. A series circuit having a current limiting resistor R3 in series with an LED is placed across the device P1 used in one or more of the safety circuits described previously, and the voltage across the series circuit is not sufficient enough to cause the LED to light. When device P1 goes to a high impedance state, the voltage across the device P1 and the series circuit of resistor R3 and the LED is sufficient to light the LED and indicate to the user that an overheat condition has occurred at the time the product is being improperly used. The LED can shine through a window, such as on a housing of the control unit 56, having a caution symbol such as an exclamation mark ("!"), to indicate to the user that the safety mode has taken over. The automatic fault indicator shown in FIG. 10 may be incorporated in one or more of the circuits of the present invention described herein.

Referring now to FIG. 11, a dual circuit for a heating pad or electric blanket 50 of the present invention is illustrated and will now be described for the wire configuration of the previous example shown in FIG. 9. A heating pad with dual, or multi-circuit, heating elements (wires) has the advantage that a smaller area of overheat comprises a higher percentage of the heater wire element and thus the power is reduced to the heater wires and an overheat is avoided. Two PPTC devices P2 and P3 limit the heating of the wires should a meltdown of the separation layer occur at any place along the lengths of the heater wires. A condition where the corner of the heating pad or electric blanket 50 is folded over, for example, causing a high temperature within the fold, would encompass 50% of the heating circuit when a dual circuit is used. With a single circuit, on the other hand, 25% of the heating area is encompassed. The dual circuit heating pad 50 thus is more responsive to lowering the heat of the high heat zone, preventing in most cases the insulation between the heating conductors from melting. A three-wire control cord 58 having conductors 33, 34 and 35 connects the control unit 56 to the pad 50 and to the four ends of each dual wound heater wires at nodes 25, 26, 27, 28 and 29, 30, 31, 32.

More specifically, and as shown in FIG. 11 of the drawings, the dual circuit includes a first circuit and a second circuit. The first circuit includes a 120 VAC power line 35, which includes a triac T2 connected to the 120 VAC source and connected in series to a PPTC device P3. The device P3 is connected at node 31 preferably located on a printed circuit board 36 or connector, such as described previously with respect to the embodiment shown in FIG. 9, to the first end of a first outer heater conductor 3' (such as shown in FIG. 1A) having a resistance R7 of a first heater wire that extends over at least a portion of the electric blanket or heating pad 50. The second end of the first outer heater conductor 3' is connected to node 30 preferably located on the printed circuit board 36 or connector, and node 30 is connected to node 32 on the printed circuit board 36 or connector, to which is connected the first end of the first inner conductor 1' of the first heater wire (such as shown in FIG. 1A) having a resistance R6. The second end of the first inner conductor 1' having a resistance R6 is connected to node 29 on the printed circuit board 36 or connector of the heating pad or electric blanket 50. Node 29 is connected to the neutral (N) power line 33. The neutral (N) power line 33 is also connected to node 28 on the printed circuit board 36 or connector of the second circuit of the dual circuit of the present invention. Node 28 is connected to the first end of a second inner conductor 1' of a second heater wire (such as shown in FIG. 1A) having a resistance R4 associated therewith. The second end of the second inner conductor 1' having a resistance R4 is connected to node 25 on the printed circuit board 36 or connector of the heating pad or electric blanket 50. Node 25 is connected to node 27 on the printed circuit board 36 or connector, to which is also connected the first end of a second outer heater conductor 3' of the second heater wire (such as shown in FIG. 1A) having a resistance R5. The second end of the second outer conductor 3' having a resistance R5 is connected to node 26 on the printed circuit board 36 or connector of the heating pad or electric blanket 50. Node 26 is connected to a 120 VAC power line 34, which includes a second triac T3 connected to the 120 VAC source, which triac T3 is connected in series with a second PPTC device P2, whose other end is connected to node 26. There is a low melt insulate layer 2' situated in each of the first and second heater wires between the outer conductors 3' having resistances R7 and R5 of the first and second circuits, and the inner conductors 1' having resistances R6 and R4 of the first and second circuits, such as shown in FIG. 1A of the drawings. To facilitate an explanation of the dual circuit of the present invention, possible shorts are illustrated in FIG. 11 by lines S7, S8 and S9 between the outer conductor 3' having resistance R7 and the inner conductor 1' having resistance R6 of the first heater wire of the first heater circuit and located at points 25% (short S9), 50% (short S8) and 75% (short S7) along the length of the first heater wire measured from the beginning of the first heater wire where it is connected to the 120 VAC power line 35. Similarly, shorts in the second heater wire of the second heater circuit are exemplified in FIG. 11 by lines S6, S5 and S4 between the outer conductor 3' having resistance R5 and the inner conductor 1' having resistance R4 of the second heater wire of the second circuit and located at points 25% (short S4), 50% (short S5) and 75% (short S6) along the length of the second heater wire measured from the beginning of the second heater wire where it is connected to the 120 volt AC line 34.

A short due to a meltdown at location S4, S5 or S6 will cause the PPTC device P2 to trip into a high impedance state in the second heater circuit (the lower circuit shown in FIG. 11), and a short at location S7, S8 or S9 will cause the PPTC device P3 to trip into a high impedance state in the first heater circuit (the upper circuit shown in FIG. 11), thus limiting power to either side of the pad or electric blanket 50 in which a fault, such as a short, or overheat condition occurs. The inner and outer heater conductors 1' and 3' respectively having resistances R4 and R5 in the second circuit (the lower circuit shown in FIG. 11) are powered by switching the triac T3 on. The inner and outer heater conductors 1' and 3' respectively having resistances R4 and R5 of the second heating circuit exhibit a positive temperature coefficient of resistance effect that is detected by the control unit 56 as previously described. Similarly, the inner and outer heater conductors 1' and 3' respectively having resistances R6 and R7 in the first heater circuit (shown as the upper circuit in FIG. 11) are powered by switching the triac T2 on, and the heater wire temperature is monitored in a similar manner as in the second (lower) circuit.

Figure 12:
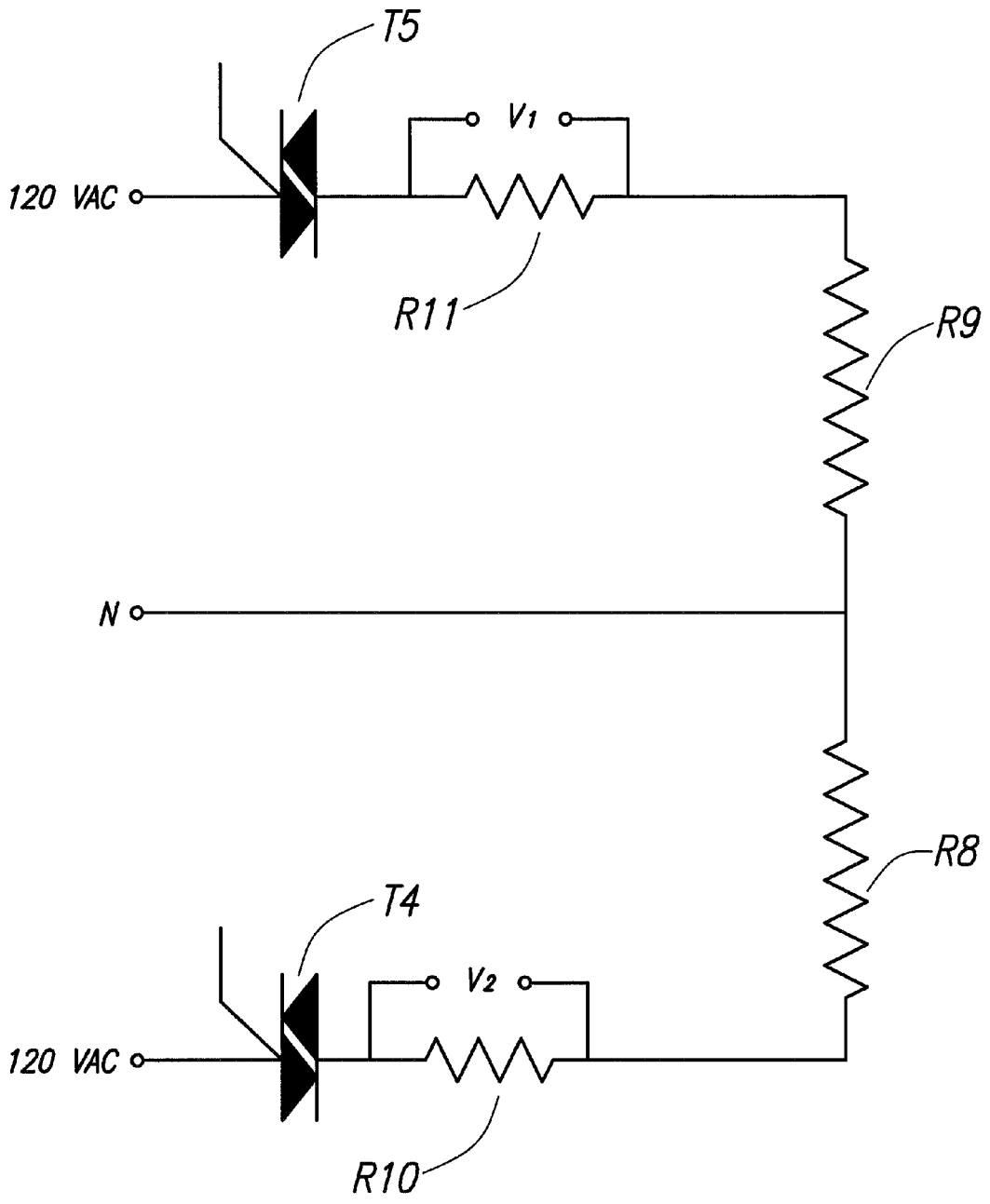
FIG. 12 is a circuit diagram of a simplified dual heater circuit constructed in accordance with another preferred embodiment of the present invention.

The advantages of a dual circuit heating pad 50 formed in accordance with the present invention can be realized for any control method, this being illustrated in a simplified form in FIG. 12. The simplified dual heater circuit includes a first heater conductor having resistance R9 and a second heater conductor having resistance R8. The heater conductors are made of an alloy that exhibits a positive temperature resistance change with temperature. Nickel and Copper are examples of such metals. A resistor R10 is situated in series with the first end of the second heater conductor having resistance R8, and a resistor R11 is situated in series with the first end of the first heater conductor having resistance R9. An end of resistor R11 is connected to a first triac T5, whose other end is connected to the 120 VAC power line. The second end of the first heater conductor having resistance R9 is connected to the neutral (N) power line which is also connected to the second end of the second heater conductor having resistance R8. The other end of resistor R10 is connected to a second triac T4 which, in turn, is connected to the 120 VAC power line The series resistors R10 and R11 are of a low resistance value such as 1 ohm (Ω) to avoid heating the resistors R10 and R11 to any significant degree. Triac T4 controls the current to the series resistor R10 and to the second heater conductor having resistance R8. Similarly, triac T5 controls the current to the series resistor R11 and to the first heater conductor having resistance R9. For the first and second heater conductors respectively having resistances R8 and R9 made of Nickel, the resistance increases by about 0.5% per ° C. If, for example, the resistance of the heater conductors having resistances R8 and R9 is 200Ω at 20° C., and each series resistor R10, R11 is 1Ω, the voltage across each series resistor is 0.597 VAC. At a wire temperature of 90° C., which is an increase of 70° C., the heater conductor having resistance R8 or R9 would be 35% higher, or 270Ω, and the voltage V1 or V2 respectively across the 1Ω series resistor R10 or R11 is 0.442 VAC. In a control circuit in control unit 56, the sensing voltage V1 and V2 can be rectified, and with a comparator, referenced to a known reference resistor at 90° phase to determine the temperature of the heater conductors. This example is illustrated for simplicity, and it should be realized that other dual circuit control methods, including using NTC (negative temperature coefficient) or PTC (positive temperature coefficient) sensing layers within the heater wire, may also be used. It should be further realized that one or more sensing resistors, such as described above, may be used in the other circuits of the present invention described herein and, for example, may be used with or without the PPTC device in the circuits.

Figure 14:
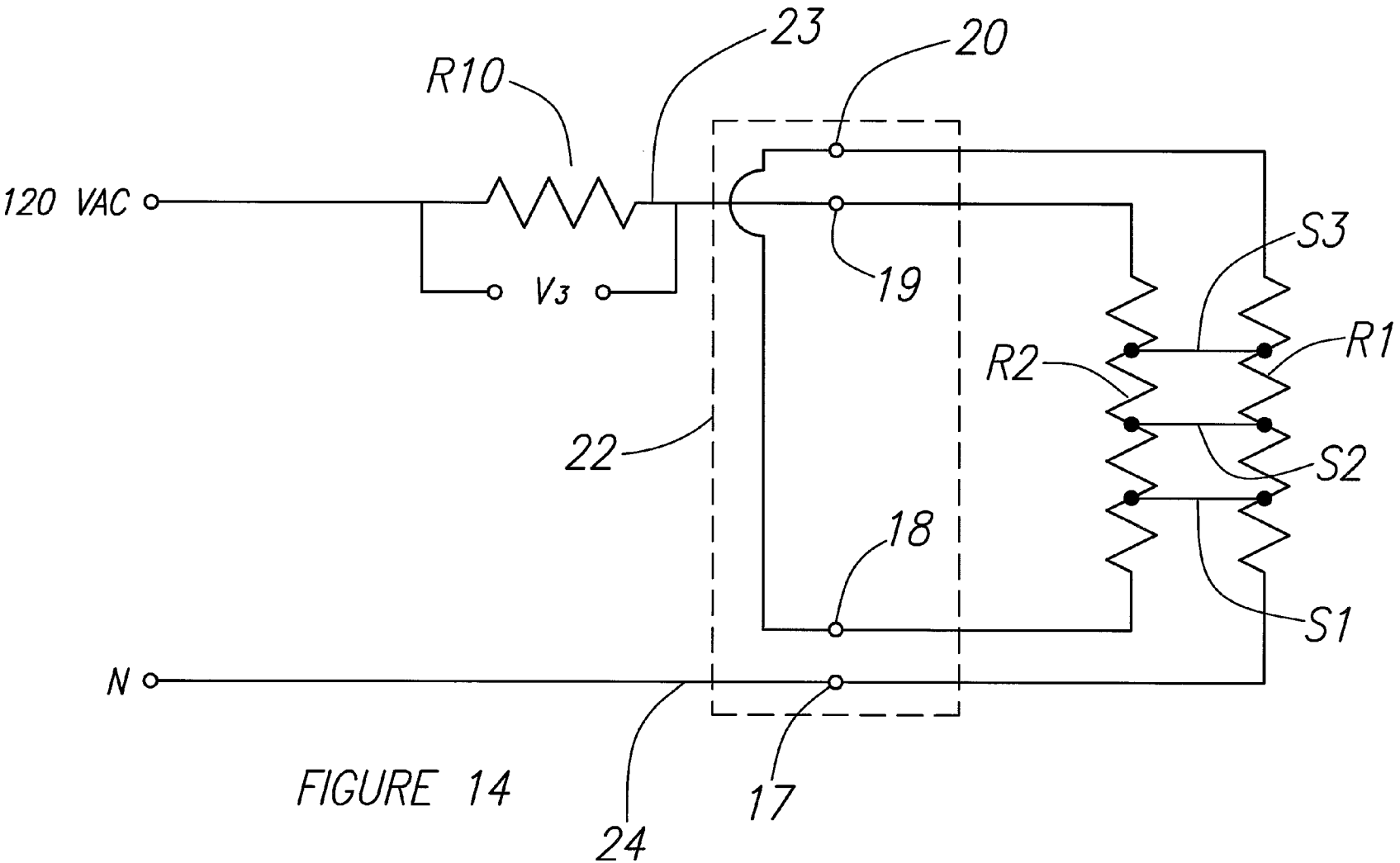
FIG. 14 is a schematic diagram of another version of the heater wire safety circuit (safety overheat protection circuit) shown in FIG. 9, where the fuse F1 of the circuit of FIG. 9 is omitted and the PPTC device P1 of FIG. 9 is replaced by a series sensing resistor R10.
Figure 15:
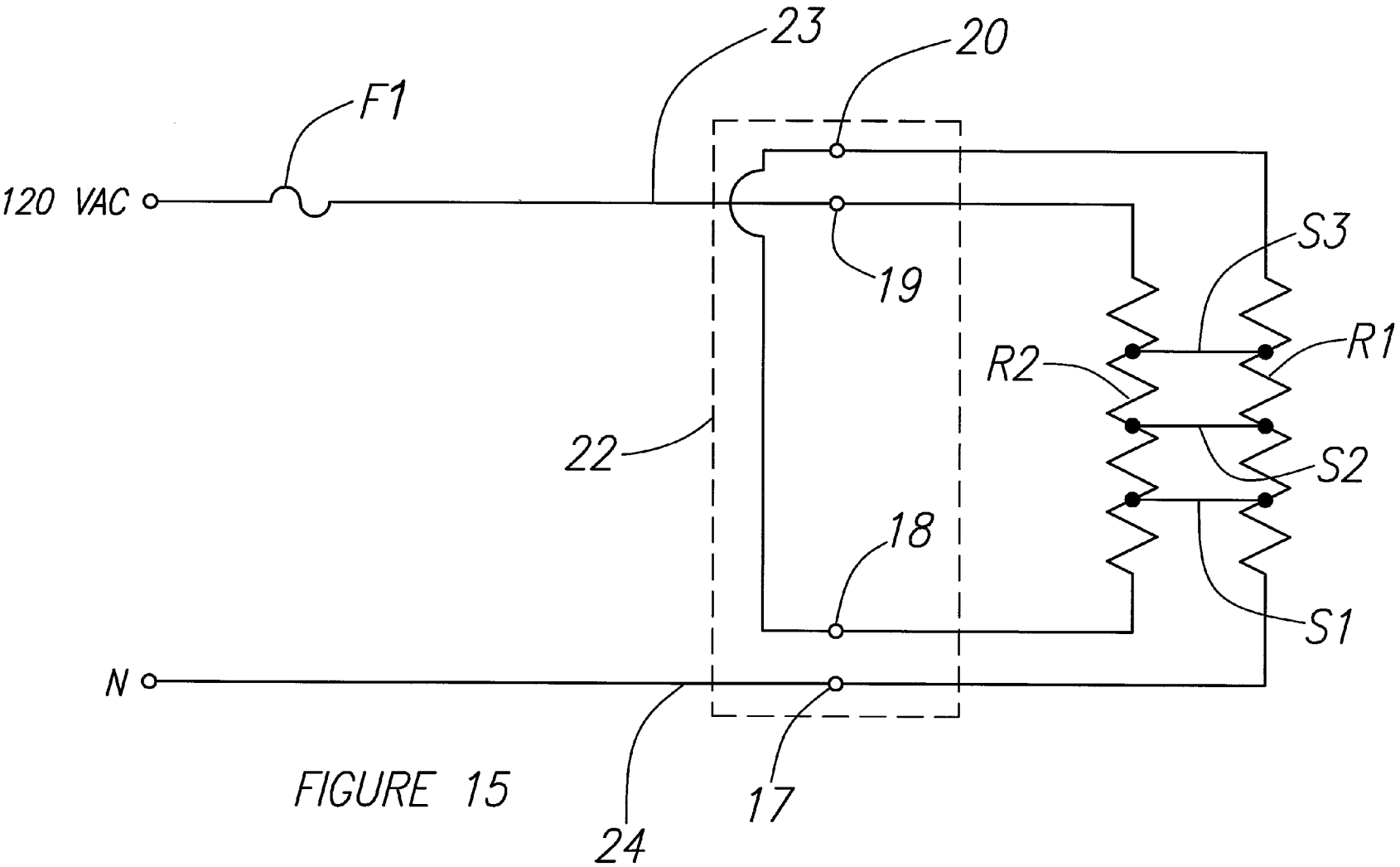
FIG. 15 is a schematic diagram of yet another version of the heater wire safety circuit (safety overheat protection circuit) shown in FIG. 9, where the PPTC device P1 of the circuit of FIG. 9 is omitted.

FIGS. 14 and 15 show variations of the heater wire safety circuit of the present invention shown in FIG. 9. More specifically, in FIG. 14, the fuse F1 in the circuit of FIG. 9 is omitted, and the PPTC device P1 has been replaced with a series connected sensing resistor R10, such as shown in FIG. 12 and described previously. The voltage V3 across resistor R10 (preferably 1Ω) may be monitored in the same manner as described previously with respect to the circuit shown in FIG. 12 to determine if an over current condition exists in the heater wire circuit. FIG. 15 shows a circuit similar to that shown in FIG. 9, but with the PPTC device P1 omitted. Fuse F1 protects the circuit should an overheat condition occur, as described previously with respect to the other embodiments of the present invention employing fuses.

By way of illustration, schematics have been presented for both single and dual temperature control circuits, and also for both full and half cycle power, to describe the operation of the present invention. The particular materials described are for example, and the invention is not limited to the particular materials other than their properties relative to the intent of the function of the circuit.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A heater wire safety circuit for use with an electric blanket or heating pad, which comprises:

a first heater circuit and a second heater circuit, wherein the first heater circuit includes:

a first heater conductor to provide heat to the electric blanket or heating pad over at least a portion thereof, the first heater conductor having a first end and a second end situated opposite to the first end;

a second heater conductor to provide heat to the electric blanket or heating pad over at least a portion thereof, the second heater conductor having a first end and a second end situated opposite to the first end of the second heater conductor;

a first low melt insulate layer situated between the first heater conductor and the second heater conductor along at least a portion of the length of at least one of the first heater conductor and the second heater conductor, the second end of the second heater conductor being connected to the first end of the first heater conductor; and a first polymetric positive temperature coefficient (PPTC) device, the first PPTC device having a first side connected to the second end of the first heater conductor, and having a second side which is in electrical communication with one of the hot line and the neutral line of a power source;

and wherein the second heater circuit includes:

a third heater conductor to provide heat to the electric blanket or heating pad over at least a portion thereof, the third heating conductor having a first end and a second end situated opposite to the first end of the third heater conductor;

a fourth heater conductor to provide heat to the electric blanket or heating pad over at least a portion thereof, the fourth heater conductor having a first end and a second end situated opposite to the first end of the fourth heater conductor;

a second low melt insulate layer situated between the third heater conductor and the fourth heater conductor along at least a portion of the length of at least one of the third heater conductor and the fourth heater conductor, the second end of the third heater conductor being connected to the first end of the fourth heater conductor, the second end of the fourth heater conductor being connected to the first end of the second heater conductor and being in electrical communication with one of the neutral line and the hot line of a power source; and a second PPTC device, the second PPTC device having a first side which is connected to the first end of the third heater conductor, and having a second side which is in electrical communication with one of the hot line and neutral line of a power source.

2. A heater wire safety circuit as defined by claim 1, wherein the first heater circuit includes a first switching circuit, the first switching circuit having a first side which is connected to the second side of the first PPTC device, and having a second side which is in electrical communication with one of the hot line and the neutral line of a power source; and wherein the second heater circuit includes a second switching circuit, the second switching circuit having a first side which is connected to the second side of the second PPTC device, and having a second side which is in electrical communication with one of the hot line and the neutral line of a power source.

3. An electric blanket or heating pad having the heater wire safety circuit as defined by claim 1.

4. A heater wire safety circuit for use with an electric blanket or heating pad, which comprises:

a first heater circuit and a second heater circuit, wherein the first heater circuit includes:

a first heater conductor to provide heat to the electric blanket or heating pad over at least a portion thereof, the first heater conductor having a first end and a second end situated opposite to the first end;

a second heater conductor to provide heat to the electric blanket or heating pad over at least a portion thereof, the second heater conductor having a first end and a second end situated opposite to the first end of the second heater conductor;

a first low melt insulate layer situated between the first heater conductor and the second heater conductor along at least a portion of the length of at least one of the first heater conductor and the second heater conductor, the second end of the second heater conductor being connected to the first end of the first heater conductor; and a first fuse, the first fuse being in electrical communication with the second end of the first heater conductor, and being in electrical communication with one of the hot line and the neutral line of a power source;

and wherein the second heater circuit includes:

a third heater conductor to provide heat to the electric blanket or heating pad over at least a portion thereof, the third heating conductor having a first end and a second end situated opposite to the first end of the third heater conductor;

a fourth heater conductor to provide heat to the electric blanket or heating pad over at least a portion thereof, the fourth heater conductor having a first end and a second end situated opposite to the first end of the fourth heater conductor;

a second low melt insulate layer situated between the third heater conductor and the fourth heater conductor along at least a portion of the length of at least one of the third heater conductor and the fourth heater conductor, the second end of the third heater conductor being connected to the first end of the fourth heater conductor, the second end of the fourth heater conductor being connected to the first end of the second heater conductor and being in electrical communication with one of the neutral line and the hot line of a power source; and a second fuse, the second fuse being in electrical communication with the first end of the third heater conductor, and being in electrical communication with one of the hot line and the neutral line of a power source.

5. A heater wire safety circuit as defined by claim 4, wherein the first heater circuit includes a first switching circuit, the first switching circuit being in electrical communication with the first fuse, and being in electrical communication with one of the hot line and the neutral line of a power source; and wherein the second heater circuit includes a second switching circuit, the second switching circuit being in electrical communication with the second fuse, and being in electrical communication with one of the hot line and the neutral line of a power source.

6. An electrical blanket or heating pad having the heater wire safety circuit as defined by claim 4.

7. A heater wire safety circuit for use with an electric blanket or heating pad, which comprises:

a first heater circuit and a second heater circuit, wherein the first heater circuit includes:

a first heater conductor to provide heat to the electric blanket or heating pad over at least a portion thereof, the first heater conductor having a first end and a second end situated opposite to the first end;

a second heater conductor to provide heat to the electric blanket or heating pad over at least a portion thereof, the second heater conductor having a first end and a second end situated opposite to the first end of the second heater conductor;

a first low melt insulate layer situated between the first heater conductor and the second heater conductor along at least a portion of the length of at least one of the first heater conductor and the second heater conductor, the second end of the second heater conductor being connected to the first end of the first heater conductor; and a first current limiting circuit, the first current limiting circuit having a first side which is connected to the second end of the first heater conductor, and having a second side which is in electrical communication with one of the hot line and the neutral line of a power source;

and wherein the second heater circuit includes:

a third heater conductor to provide heat to the electric blanket or heating pad over at least a portion thereof, the third heating conductor having a first end and a second end situated opposite to the first end of the third heater conductor;

a fourth heater conductor to provide heat to the electric blanket or heating pad over at least a portion thereof, the fourth heater conductor having a first end and a second end situated opposite to the first end of the fourth heater conductor;

a second low melt insulate layer situated between the third heater conductor and the fourth heater conductor along at least a portion of the length of at least one of the third heater conductor and the fourth heater conductor, the second end of the third heater conductor being connected to the first end of the fourth heater conductor, the second end of the fourth heater conductor being connected to the first end of the second heater conductor and being in electrical communication with one of the neutral line and the hot line of a power source; and a second current limiting circuit, the second current limiting circuit having a first side which is connected to the first end of the third heater conductor, and having a second side which is in electrical communication with one of the hot line and the neutral line of a power source.

8. A heater wire safety circuit as defined by claim 7, wherein at least one of the first current limiting circuit and the second current limiting circuit includes a polymetric positive temperature coefficient (PPTC) device.

9. A heater wire safety circuit as defined by claim 7, wherein at least one of the first current limiting circuit and the second current limiting circuit includes a triac.

10. A heater wire safety circuit as defined by claim 7, wherein at least one of the first current limiting circuit and the second current limiting circuit includes a triac and a polymetric positive temperature coefficient (PPTC) device electrically connected in series with the triac.

11. A heater wire safety circuit as defined by claim 7, wherein at least one of the first current limiting circuit and the second current limiting circuit includes a fuse.

12. A heater wire safety circuit as defined by claim 7, wherein at least one of the first current limiting circuit and the second current limiting circuit includes a triac and a fuse electrically connected in series with the triac.

13. An electrical blanket or heating pad having the heater wire safety circuit as defined by claim 7.

14. A heater wire safety circuit for use with an electric blanket or heating pad, which comprises:

a first heater circuit and a second heater circuit, wherein the first heater circuit includes:

a first heater conductor to provide heat to the electric blanket or heating pad over at least a portion thereof, the first heater conductor having a first end and a second end situated opposite to the first end;

a second heater conductor to provide heat to the electric blanket or heating pad over at least a portion thereof, the second heater conductor having a first end and a second end situated opposite to the first end of the second heater conductor; and a first low melt insulate layer situated between the first heater conductor and the second heater conductor along at least a portion of the length of at least one of the first heater conductor and the second heater conductor, the second end of the second heater conductor being connected to the first end of the first heater conductor;

wherein the second end of the first heater conductor is in electrical communication with the hot line of a power source, and the first end of the second heater conductor is in electrical communication with the neutral line of a power source;

and wherein the second heater circuit includes:

a third heater conductor to provide heat to the electric blanket or heating pad over at least a portion thereof, the third heating conductor having a first end and a second end situated opposite to the first end of the third heater conductor;

a fourth heater conductor to provide heat to the electric blanket or heating pad over at least a portion thereof, the fourth heater conductor having a first end and a second end situated opposite to the first end of the fourth heater conductor; and a second low melt insulate layer situated between the third heater conductor and the fourth heater conductor along at least a portion of the length of at least one of the third heater conductor and the fourth heater conductor, the second end of the third heater conductor being connected to the first end of the fourth heater conductor, the second end of the fourth heater conductor being connected to the first end of the second heater conductor and being in electrical communication with the neutral line of a power source;

wherein the first end of the third heater conductor is in electrical communication with the hot line of a power source; and a fuse, the fuse having a first side connected to the first end of the second heater conductor and to the second end of the fourth heater conductor, and having a second side which is in electrical communication with the neutral line of a power source.

15. A heater wire safety circuit as defined by claim 14, wherein the first heater circuit includes a first switching circuit, the first switching circuit being in electrical communication with the second end of the first heater conductor, and being in electrical communication with the hot line of a power source; and wherein the second heater circuit includes a second switching circuit, the second switching circuit being in electrical communication with the first end of the third heater conductor, and being in electrical communication with the hot line of a power source.

16. An electrical blanket or heating pad having the heater wire safety circuit as defined by claim 14.

* * * * *